US010767391B2

(12) United States Patent
Ruff

(10) Patent No.: US 10,767,391 B2
(45) Date of Patent: Sep. 8, 2020

(54) DEVICE FOR AN ACTUATION HANDLE, ACTUATION HANDLE, AND METHOD FOR WIRELESS TRANSMISSION OF A SIGNAL GENERATED BY AUTONOMOUS ENERGY

(71) Applicant: ZF Friedrichshafen AG, Friedrichshafen (DE)

(72) Inventor: Eduard Ruff, Auerbach (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 1018 days.

(21) Appl. No.: 15/129,063

(22) PCT Filed: Feb. 19, 2015

(86) PCT No.: PCT/EP2015/053464
§ 371 (c)(1),
(2) Date: Sep. 26, 2016

(87) PCT Pub. No.: WO2015/144362
PCT Pub. Date: Oct. 1, 2015

(65) Prior Publication Data

US 2017/0107739 A1 Apr. 20, 2017

(30) Foreign Application Priority Data

Mar. 27, 2014 (DE) ..... 10 2014 205 720

(51) Int. Cl.
*E05B 1/00* (2006.01)
*E05B 17/22* (2006.01)
(Continued)

(52) U.S. Cl.
CPC ..... *E05B 45/06* (2013.01); *E05B 1/003* (2013.01); *E05B 17/22* (2013.01); *E05B 47/00* (2013.01);
(Continued)

(58) Field of Classification Search
CPC ..... E05B 45/06; E05B 47/00; E05B 1/003; E05B 17/22; E05B 2047/0067; E05B 2045/0615; E05B 2047/0062
See application file for complete search history.

(56) References Cited

U.S. PATENT DOCUMENTS 7,145,436 B2 * 12/2006 Ichikawa ..... E05B 85/01 340/5.72
7,795,746 B2 * 9/2010 Riley ..... H02K 7/1853 290/1 R
(Continued)

FOREIGN PATENT DOCUMENTS

DE 296 03 917 U1 6/1996
DE 103 61 774 A1 8/2005
(Continued)

OTHER PUBLICATIONS

International Search Report dated May 29, 2015 in International Application No. PCT/EP2015/053464, 4 pages, German Language.
(Continued)

*Primary Examiner* — Kristina R Fulton
*Assistant Examiner* — Thomas L Neubauer

(57) ABSTRACT

The present disclosure relates to a device for an actuation handle, having an actuation bolt, which has at least one section along its longitudinal axis (A) having at least one outer edge on its circumference. The device comprises a housing having a first receiving section for receiving an energy converter for supplying electrical energy to a radio transmitter by converting mechanical energy into electrical energy, and an aperture for the actuation bolt, wherein the aperture has a second receiving section for rotatably accommodating the section of the actuation bolt having at least one outer edge. The device is characterized in that the first receiving section is disposed such that it is adjacent to the aperture, wherein a switch element of the energy converter
(Continued)

Figure 1:
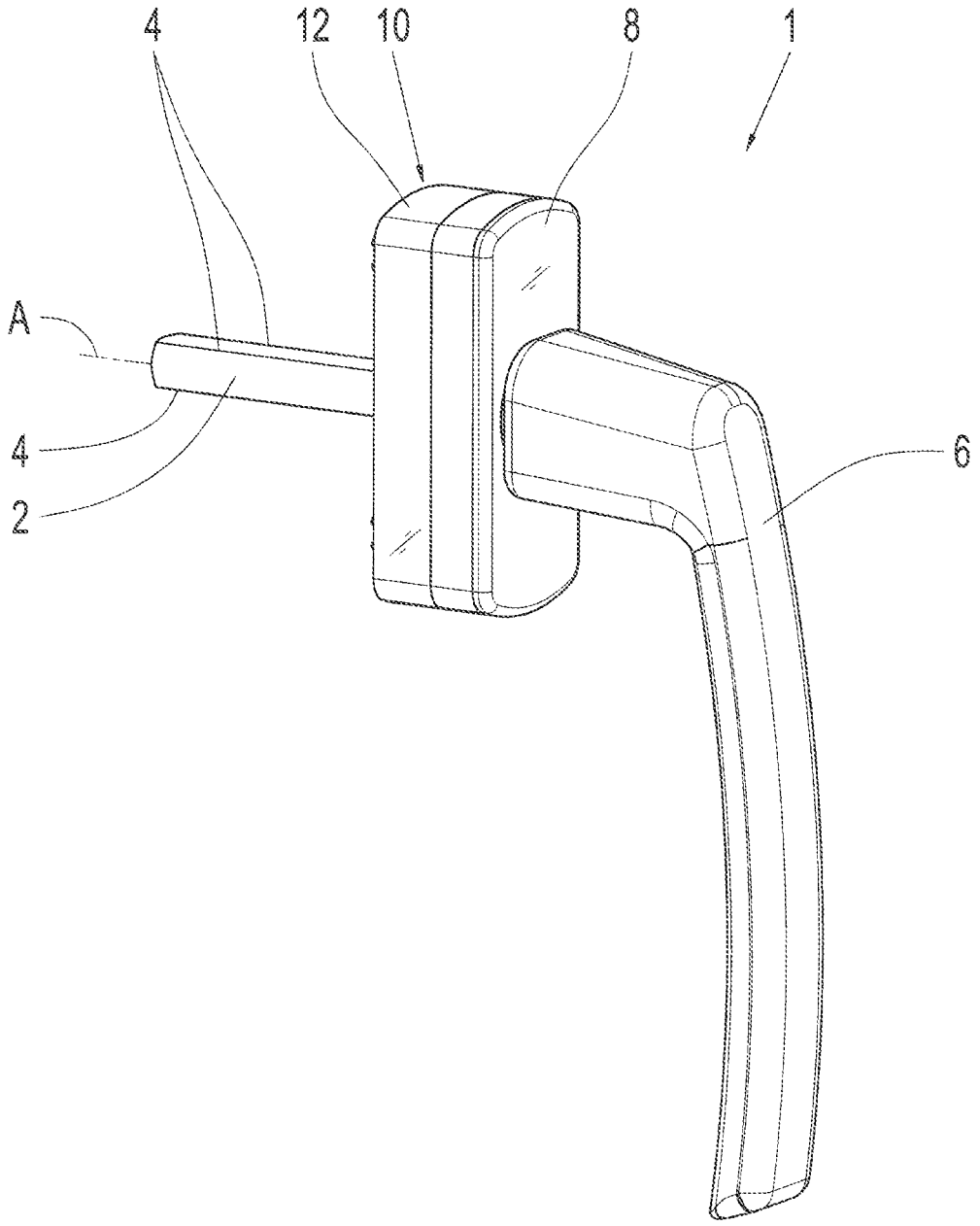

extends into a rotational path of the at least one outer edge when the energy converter is in a receiving state, and can be actuated such that it causes a switching by means of the at least one outer edge during a rotation of the actuation bolt.

20 Claims, 8 Drawing Sheets

(51) Int. Cl.
*E05B 45/06* (2006.01)
*E05B 47/00* (2006.01)

(52) U.S. Cl.
CPC ..... *E05B 2045/0615* (2013.01); *E05B 2047/0062* (2013.01); *E05B 2047/0067* (2013.01)

(56) References Cited

U.S. PATENT DOCUMENTS 8,322,761 B2 * 12/2012 Itami ..... E05B 81/20 292/201
9,151,079 B2 10/2015 Webb et al.
2013/0192317 A1 * 8/2013 McKibben ..... E05B 47/0001 70/278.1
2014/0001779 A1 1/2014 Bedoian et al.
2014/0139048 A1 5/2014 Ruff

FOREIGN PATENT DOCUMENTS

DE 10 2004 018 064 A1 10/2005
DE 20 2005 006 796 U1 1/2007
DE 20 2012 003 659 U1 6/2012
WO WO 2006/074967 A1 7/2006

OTHER PUBLICATIONS

Written Opinion of the International Search Authority dated Feb. 19, 2015 in International Application No. PCT/EP2015/053464, 6 pages, German Language.
English Language Translation of International Search Report dated May 29, 2015 in International Application No. PCT/EP2015/053464, 3 pages.
Office Action of Priority Application DE102014205720.5 dated Jan. 12, 2015, 9 pages, German Language, including English Translation of p. 7.

* cited by examiner

DEVICE FOR AN ACTUATION HANDLE, ACTUATION HANDLE, AND METHOD FOR WIRELESS TRANSMISSION OF A SIGNAL GENERATED BY AUTONOMOUS ENERGY

This application is a filing under 35 U.S.C. § 371 of International Patent Application PCT/EP2015/053464, filed Feb. 19, 2015, and claims the priority of DE 10 2014 205 720.5, filed Mar. 27, 2014. These applications are incorporated by reference herein in their entirety.

The disclosure relates to a device for an actuation handle, in particular an energy self-sufficient device for detecting at least one actuation, more preferably an actuation direction of the actuation handle, and furthermore preferably, a position of the actuation handle, as well as to a wireless transmission of a signal having data regarding the detected actuation, actuation direction, or actuation position. Furthermore, the present disclosure relates to such an actuation handle and a method for the wireless transmission of an energy self-sufficient generated signal by means of an actuation handle.

Energy self-sufficient systems are used in the field of building automation, e.g. in installation switches and window and door handles. Energy self-sufficient systems are distinguished in that the system comprises a device that generates electric energy, thus requiring no electrical connection, as a result of which, connectors and wiring can be eliminated. Such an energy generating device can be a solar cell, a piezoelectric transducer, an inductive transformer, or suchlike. Such energy generators are advantageous in this regard, in that the energy required for generating electricity can be taken from the environment or from mechanical energy necessary for actuation of the installation switch or the window or door handle, whereby this type of energy converter is independent of battery capacities and maintenance measures.

Such energy self-sufficient systems are used in conjunction with status monitoring, primarily based on radio signal solutions. The radio signal solutions have the advantage that there is no need for a complex wiring.

By way of example, EP 1 838 941 B1 discloses an energy self-sufficient radio solution for an actuation handle, with a device based on an inductive transformer having the features specified in the preamble.

Additionally, a uniform handle design has been established in the field of window and door handles, which is composed of a standardized housing and a uniform interface to a locking mechanism. The interface is usually formed by a square bolt, which is non-rotatably coupled to a handle piece, and engages with its free end in the locking mechanism. The housing has attachment means thereby, for the attachment thereof to the window frame or to the door.

Independent of the exterior design, there is increasing interest in self-sufficient radio systems, which are capable of transmitting complex radio protocols such as KNX-RF, ZigBee, Bluetooth Low Energy or W-LAN with a higher transmitting power and with numerous repetitions. High demands are also placed on the data transfer reliability. Furthermore, the self-sufficient radio system should also offer the possibility of easily retrofitting already existing solutions.

With the present disclosure, a device is to be provided for an actuation handle that fulfills at least one, preferably all, of the demands specified above. In particular, the device should be economical and function in an energy self-sufficient manner, without the need for maintenance. Furthermore, the device should preferably be designed such the standardized design can be retained. Moreover, the design should be designed such that it can be retrofitted to existing solutions. In addition, it is further preferred that different functional settings of the actuation handle can be detected. Moreover, it is further preferred that a high data transfer reliability is ensured.

The present disclosure therefore proposes, according to one aspect, a device for an actuation handle, having an actuation bolt, which has at least one section running along its longitudinal axis with at least one outer edge disposed on the circumference, wherein the device is designed for at least detecting an actuation of the actuation handle. The actuation handle is preferably a rotatable handle piece, in particular a window handle or a door handle.

The device comprises a housing, having a first receiving section for receiving an energy converter for supplying a radio transmitter module with electricity by converting mechanical energy into electrical energy. In other words, the electrical energy generated by the energy converter is used by the radio transmitter module, in particular, for the generation and wireless transmission of a radio signal.

The housing furthermore has an aperture. The aperture has a second receiving section for rotatably accommodating the section of the actuation bolt having the at least one outer edge. The aperture preferably extends in the direction of the aperture at least along the second receiving section. Thus, other elements, disposed outside the second receiving section, can be allocated to the aperture. The actuation bolt can be inserted into the aperture, and extends along the aperture direction, or the insertion direction, respectively, beyond the aperture on at least one side, preferably on both sides, when in a functional connection with the device. Furthermore, an aperture hole formed in the housing, for example, can preferably be allocated to the aperture. Moreover, the second receiving section can preferably be allocated to the aperture hole.

The present disclosure is the first receiving section is disposed such that it borders on the aperture, wherein, when the energy converter is in a receiving state, at least one switch element of the energy converter extends into, or crosses, a rotational path of the at least one outer edge, and can be actuated in a switch-effecting manner by means of the at least one outer edge during a rotation of the actuation bolt. In this context, switch-effecting means that the energy converter converts a mechanical energy applied to the switch element by the at least one outer edge into electrical energy, by means of the switch-effecting actuation of the switch element. The energy converter is preferably an inductive transformer. The energy converter is furthermore preferably a component of the device. It is further preferred that the energy converter has a soft magnetic or magnetizable element, and a permanent magnet, which are disposed such that they can be moved in relation to one another by means of the switch element. The stationary component of this energy converter assembly is encompassed by at least one coil, wherein the moving component of this assembly can be moved toward the stationary component by means of the switch element. The stationary and moving components are designed such that a temporal change to the magnetic flux, or a magnetic flux reversal is caused in the assembly by means of the relative movement, which causes, respectively, a generation of an induction voltage in the coil. The switch element is preferably a spring element or a spring mechanism thereby, which is designed for transferring the mechanical energy transmitted from the at least one outer edge to the moving component of the assembly by moving it. It is furthermore preferred that the switch element is designed to first store the mechanical energy transmitted from the at least one outer edge, and when a switchover point has been reached, to transfer this mechanical energy to the moving component of the assembly. It is further preferred that the energy converter is an induction generator in accordance with DE 10 2011 078 932 A1. This energy converter is advantageous in this regard, in that a significantly larger electrical energy yield can be obtained in comparison with other previously known inductive converters.

The second receiving section is preferably designed such that at least one section of the actuation bolt can be received by a section of the at least one outer edge that is sufficient for a switch-effecting actuation of the energy converter. The second receiving section, in other words, is preferably designed in relation to the outer dimensions of the section having at least one outer edge, such that it can receive, entirely or in part, a section of the actuation bolt having the at least one outer edge. The second receiving section preferably extends between opposing aperture holes in the direction of the aperture, through which the actuation bolt can be passed through the housing when said housing is being installed. It is further preferred that the second receiving section has an external size corresponding to an outer size of the section having the at least one outer edge in the same direction, in a direction orthogonal to the aperture direction.

The proposed device can have a more compact design as a result of the direct actuation of the energy converter by means of an outer edge provided on the actuation bolt. As a result, the housing can be adapted to the standardized design of a standard handle. The device is energy self-sufficient as a result of the energy converter, and designed such that it does not require maintenance. On the basis, for example, of a use of the previously known energy converter described above, energy demanding radio protocols can be easily implemented.

The actuation bolt is preferably designed as a multi-sided bolt. It is further preferred that the actuation bolt is formed by a square pin previously known from the range of standard handles. Thereby, at least one of the edges running on the outside of the actuation bolt in the direction of the longitudinal axis forms the at least one outer edge. It is further preferred that more than one of the edges running along the outside of the actuation bolt in the direction of the longitudinal axis form an outer edge that is suitable for a switch-effecting actuation of the energy converter. Alternatively or additionally, the outer edge can be formed by a projection protruding from the outer surface of the actuation bolt. The projection can have any shape thereby that is suitable for a switch-effecting actuation of the energy converter. In particular, the at least one outer edge or the projection forms a peak in terms of its cross section, which travels along a preferably circular path during the rotational movement of the actuation bolt, which is crossed by the switch element, in particular a punctiform or planar actuation element of the switch element. During a rotational movement of the actuation bolt, the switch element ends up bearing on the outer edge, or the projection, respectively, and is carried, or moved, by the outer edge, or the projection, respectively, from an initial position of the switch element to at least a switching position of the switch element, for a switch-effecting actuation of the energy converter.

Further preferred embodiments of the present disclosure are the subject matter of the dependent claims.

According to a preferred embodiment, the housing has a pan-like section, which forms the first receiving section and the aperture having the second receiving section, wherein the aperture has an aperture hole formed in the pan base in the direction of the aperture. A single space is created by this means, which can be covered, or more preferably, sealed, with respect to an outer surface of the housing, for protection against external effects.

It is further preferred that the housing forms a pan that is open on one side, which comprises the pan-like section. The housing can have a simple and compact design as a result. At least some of the housing walls forming the open pan can be used to form the pan-like section thereby.

The housing preferably has attachment means outside the pan-like section for attaching the housing to a wall provided for attaching the actuation handle. This wall can be a part of a window frame or a door, for example. It is further preferred that attachment pins on a side of the housing, protruding therefrom, form the attachment means, which are designed to engage with the actuation recesses formed in the wall provided for attaching the actuation handle. The device can thus be installed at an attachment location for the actuation handle, making use of the existing attachment means.

It is further preferred that the housing has further attachment means for attaching the actuation handle to the housing on a side of the housing having the pan-like housing section, wherein the further attachment means are disposed outside the pan-like housing section. As a result, the device can be installed on the actuation handle, and between the actuation handle and the wall provided for attaching the actuation handle. For this, the actuation handle preferably has a rosette, which can be connected to the housing via the further attachment means. A rosette is normally used for covering attachment means for the actuation handle and/or for attaching the actuation handle. The rosette furthermore optically separates the actuation bolt from an actuation section such as a handle piece for example. The rosette furthermore preferably has counter-attachment means allocated to the other attachment means, which can be brought into engagement therewith. Any connecting means may be considered for the attachment means and counter-attachment means that can form a releasable or non-releasable connection between two components. By way of example, screw, snap-in, adhesive and/or rivet connections can be used.

The housing is preferably made of plastic, more preferably an injection molded plastic. It is furthermore preferred that the housing, having the pan-like section, the attachment means and the further attachment means is formed as an integral unit. The housing can thus be produced in an economic manner.

It is further preferred that the housing has a bearing section for resting on a carrier element having at least one radio transmission antenna, which covers a section of the pan-like section encompassing at least the aperture when it is resting on the housing. In other words, the carrier element has a through-hole for the actuation bolt corresponding to or smaller than the outer dimensions of the aperture, wherein the through-hole is formed such that it is coaxial to the aperture when the it is resting on the carrier element. The bearing is preferably formed by front surface ends of the housing walls encompassing the pan-like section. Alternatively or additionally thereto, the bearing is preferably formed by front surface ends of inner housing walls, which are disposed inside the outer housing walls forming the open pan, wherein the front surface ends of the inner housing walls exhibit a smaller spacing to the pan base than the front surface ends of the outer housing walls. As a result, the carrier element comes to bear on the housing between the outer housing walls, by means of which a more compact design of the device can be obtained. The carrier element preferably has an external size corresponding to the space inside the open pan, by means of which the carrier element can cover the open pan outside the aperture region when in the bearing position. The carrier element thus forms a cover for the housing. The housing interior, of the components received in the housing interior, respectively, can be effectively protected against external influences as a result.

According to another preferred embodiment, the device has an actuation adapter element that can be non-rotatably connected to the actuation bolt, and can be received in the second receiving section, which forms the at least one outer edge on the circumference of the actuation bolt. As a result, the device can be adapted to existing solutions, which have an actuation bolt without at least one outer edge, or have a cross section that is too small for a switch-effective actuation of the energy converter.

The actuation adapter element preferably comprises a bore-hole, through which the actuation bolt can be inserted. The bore-hole preferably forms a negative of the cross-section of the actuation bolt. It is further preferred that an inner contour or inner dimensions of the bore-hole corresponds to an outer contour or outer dimensions of the actuation bolt. The actuation adapter element can thus be disposed on the actuation bolt via a punctiform or planar press fit.

Alternatively or additionally, the actuation adapter element can preferably be connected to the actuation bolt via an adhesive connection, a screw connection, a clamping connection or similar connections.

Furthermore alternatively or additionally, the actuation adapter element preferably has a stand, more preferably a base plate, from which the at least one outer edge extends, wherein the stand can be received in the aperture hole such that it can rotate. The stand preferably has an outer contour corresponding to the inner contour of the aperture hole. The outer contour and the outer dimensions of the base are preferably selected such that an unobstructed rotational movement of the stand in the aperture hole is possible.

It is furthermore preferred that stand can be retained in the aperture hole, at least in a direction parallel to the direction of the aperture hole, such that it cannot be lost. By way of example, this can be implemented via a bearing of the stand on a section of the housing base delimiting the aperture hole, acting in the direction of the aperture hole. It is further preferred that the stand is retained such that it cannot become lost in opposing directions, parallel to the direction of the aperture hole. By way of example, this can furthermore be implemented by at type of tongue-and-groove system in the aperture hole, between the stand and the housing base.

As a result of the stand, there is no need for an attachment of the actuation adapter element to such an actuation bolt, for example, having at least one outer edge or one outer projection. The actuation element is merely designed in this manner in order for the actuation element to be able to be guided by the actuation bolt during a rotational movement. This can be implemented, for example, via an engagement between the existing outer edge or the projection protruding from the outer surface of the actuation bolt with an inner surface of the actuation adapter element delimiting the bore hole.

According to another preferred embodiment, the device has a position detection device that can be coupled to the energy converter and the radio transmission module, for an electrical detection of a position of the actuation handle. The position detection device furthermore comprises an encoding element that can be non-rotatably coupled to the housing, and can encompass the actuation bolt, and an electrically conductive contact element that can be non-rotatably coupled to the actuation bolt. The encoding element can be electrically coupled to the energy converter, and has at least one electrically conductive contact bridge allocated to a position of the actuation handle that can be assumed, which can be switched between an open, electrically non-conductive state and a closed, electrically conductive state, by means of the electric contact element, wherein different positions of allocated contact bridges are insulated from one another, wherein, when a predetermined position of the actuation handle is assumed, the at least one contact bridge allocated to the position is switched to the electrically conductive state, or closed, while the other contact bridges are switched to the electrically non-conductive state, or are open. The individual positions of the actuation handle preferably correspond to functional positions of a window or door, for example, such as an open position or a closed position, or a tilted position. In this manner, a predetermined position of the actuation handle can be detected simply, transmitted to the radio transmission module, and transmitted wirelessly via the radio transmission module to a receiver, such as a status monitoring device, for example. The position detection device is thus designed to use an electrical energy generated by the energy converter for detecting the position of the actuation handle. Furthermore, the position detection device is designed to transmit data regarding the detected position to the radio transmission module by means of an electrical signal, wherein the radio transmission module processes this signal for a wireless transmission of the data.

The encoding element preferably has a contact section for each of the positions the actuation handle can assume, and a further collective contact section, electrically insulated from these contact sections, and disposed concentrically thereto, wherein the contact sections allocated to the different positions of the actuation handle are electrically insulated from one another. An electrically conductive contact bridge is thus formed by one contact section and the collective contact section.

The contact element preferably has at least one first contact for establishing an electrically conductive contact to the collective contact section, and one second contact, coupled in an electrically conductive manner to the first contact, for establishing an electrically conductive contact to one of the contact sections, depending on a position of the actuation handle. In this manner, the at least one electrically conductive contact bridge allocated to a predetermined position of the actuation handle can be switched between the open and closed state, depending on the position, or functional position, of the actuation handle.

It is further preferred that the encoding element is disposed on a printed circuit board. The printed circuit board furthermore preferably forms the carrier element having the radio transmission antenna. It is further preferred that the radio transmission module is disposed on printed circuit board. In this manner, the entire electronics system for detecting the position of the actuation handle as well as for a wireless transmission of a signal containing data regarding the detected actuation, in particular regarding the detected actuation direction and/or position of the actuation handle, can be accommodated on a printed circuit board. Preferably the electronic components forming the radio transmission module are disposed on a side of the printed circuit board facing away from the encoding element, wherein the housing has a receiving section for the electronic components. In this manner, the electronics can be provided on an inner surface protected against the outside of the device. Alternatively, the electronic components forming the radio transmission module can be provided such that they are divided between two printed circuit boards. The one printed circuit board preferably comprises only the radio transmission antenna, while the other electronic components of the radio transmission module are disposed on the second printed circuit board, which can be received in another receiving section of the housing, and can be coupled to the energy converter, in particular via plug-in contacts. The first and second printed circuit boards are preferably electrically coupled to one another by means of a plug-in contact. Alternatively, or additionally, other electronic couplings, e.g. electrical lines, sliding contacts or clamping contacts may be provided. As a result, a modular construction of the device is favored, wherein only the printed circuit board with the defective component needs to be replaced in the event of a malfunction. The printed circuit boards can be conventional printed circuit boards, a lead frame, a metal-plastic composite, or some other contact system. The radio transmission module can be a radio transmission module for bidirectional communication with a radio receiver module.

It is further preferred that the contact sections and the collective contact section are each formed by sliding contact surfaces, wherein the first and second contacts are formed by the sliding contact finger protruding from the contact element. In this manner, an electrically conductive sliding contact, depending on the position of the actuation handle can be produced between the contact element and the encoding element, in particular between the first or second contact and the corresponding contact sections assigned thereto. As a result, an economical and simply designed position detection device can be created.

According to another aspect of the present disclosure, an actuation handle is proposed. The actuation handle comprises a handle piece, an actuation bolt rotatably coupled to the handle piece, a device as described above, an energy converter for converting mechanical energy to electrical energy, and a radio transmission module coupled to the energy converter for a wireless transmission of a radio signal, wherein the energy converter supplies the radio transmission module with the electrical energy that has been generated. The actuation bolt is intended to engage in a locking or opening mechanism at its free end. The actuation handle is preferably a window or door handle, wherein the free end of the actuation bolt is designed to engage with a mechanism for closing and opening the window or door provided with the window or door. In this manner, an actuation handle complying with the requirements described in the introduction can be created.

In accordance with another aspect of the present disclosure, a method for a wireless transmission of an energy self-sufficient generated signal by means of an actuation handle is proposed, wherein the actuation handle comprises a rotatable actuation bolt having at least one outer edge, into the rotational path of which a switch element for an energy converter for converting mechanical energy into electrical energy extends, such that a rotational movement of the actuation bolt results in a switch-effecting actuation of the energy converter by means of an actuation of the switch element by the outer edge, wherein the generated electrical energy supplies a radio transmission module electrically coupled to the energy converter for a wireless transmission of the radio signal. The actuation handle is preferably a preferred actuation handle, as described above. The method comprises a step for rotating the at least one outer edge from a starting position toward an end position via an actuation position that actuates the energy converter in a switch-effecting manner. The starting position can be one of the functional positions of the actuation handle described above, wherein the end position is preferably a different functional position of the actuation handle. It is further preferred that the actuation position can be identical to the end position, or alternatively, it can lie between the starting position and the end position. The rotational step comprises a sub-step for generating an electrical energy by means of the energy converter, a subsequent sub-step for generating a radio transmission telegram containing data regarding the actuation of the actuation handle, and a subsequent sub-step for transmitting the radio transmission telegram. The generation and transmission of the radio transmission telegram occurs by means of the radio transmission module, having at least electronic components suitable for this, and a radio transmission antenna. The electronic components preferably form at least one logic module and one radio module.

The method enables an economical, self-sufficient and maintenance-free functioning status query for an actuation handle that can have a compact design.

Preferably, the energy converter is designed to be mono-stable for the method. Mono-stable means that it can generate further energy by means of the energy converter, without further actuation of the switch element. This can be implemented, for example, by means of a spring element forming the switch element, which is designed such that it automatically returns to the starting position after an actuation, by means of which a further generation of energy occurs in the energy converter. Alternatively, the energy converter preferably has a bi-stable design. Bi-stable means that further energy is generated by the energy converter, preferably by means of an actuation of a further switch element protruding into the rotational path of the at least one outer edge. This can be implemented with an actuatable reset spring, for example, coupled to the energy generating components of the energy converter, which forms another switch element that can be placed in the rotational path of the outer edge after actuation of the switch element, which remains outside of the rotational path of the outer edge after it has been actuated until the switch element has been actuated again. The method, in the case of the energy converter designed to be mono-stable or bi-stable, has further sub-steps, preferably allocated to the rotational step, following the transmitting sub-step, sequentially generating an electrical energy again by means of the energy converter, and a repeated transmission of the radio transmission telegram. As a result, an energy demanding radio protocol, for example, can be transmitted. In addition, a higher transmission frequency can be ensured, by means of which better transmission reliability can be obtained.

Alternatively, in the case of the energy converter being configured as mono-stable or bi-stable, the method has further sub-steps, allocated to the rotational step, following the transmission sub-step, sequentially generating electric energy again by means of the energy converter, generating a new radio transmission telegram, and transmitting the new radio transmission telegram. As a result, improved system reliability, in particular a manipulation reliability, can be obtained.

According to a preferred embodiment of the method, the actuation handle comprises an electric position detection device, as described above, for electrically detecting a position of the actuation handle, wherein the rotational step contains a sub-step for closing a contact bridge assigned to a position of the actuation handle for detecting the position of the actuation handle upstream of the sub-step for generating the radio transmission telegram, wherein the data in the radio transmission telegram contains data regarding the detected position of the actuation handle. The detection of the position of the actuation handle can occur, for example, by means of a query, or a signal evaluation, e.g. by means of a logic module of the radio transmission module, in particular, wherein the sub-step for the query or signal evaluation follows the sub-steps for closing and for generating an electrical energy, wherein the step for closing the contact bridge is preferably before the sub-step for querying the sub-step for generating an electric energy, and follows the sub-step for evaluating the sub-step for generating an electric energy. The latter already favors an automatic signal transmission to the logic module when the contact bridge is closed.

It is further preferred for the method that the energy converter has a mono-stable or bi-stable configuration, and the actuation handle is equipped with an electrical energy storage unit, wherein the rotational step has a sub-step for storing excess electrical energy provided between the sub-step for generating a radio transmission telegram and the sub-step for transmitting the radio transmission telegram, and preferably has a sub-step following this sub-step, for the renewed generation of electrical energy by means of the energy converter. As a result, an improved, higher energy availability can be ensured, e.g. for extensive radio protocols. The energy storage unit is preferably disposed on a printed circuit board on which at least one electronic component of the radio transmission module is mounted.

It is further preferred for the method that, in addition to the mono-stable or bi-stable configuration of the energy converter, the radio transmission module is designed for bidirectional communication with a radio receiver module assigned thereto, wherein the rotational step also contains further sub-steps, following the transmission sub-step, sequentially generating a new radio transmission telegram upon receiving a radio confirmation telegram from the radio receiver module and transmitting the new radio transmission telegram, wherein a sub-step for a renewed generation of an electrical energy by means of the energy converter precedes the sub-step for generating a new radio transmission telegram, or is inserted between the sub-step for generating a new radio transmission telegram and the sub-step for transmitting a new radio transmission telegram. As a result, improved system reliability can be ensured.

The preferred embodiments of the actuation handle, the device, and the method described above are suited in particular for window or door handle monitoring systems, by means of which a change or a manipulation of the actuation handle can be monitored. The preferred embodiments can be used, for example, in conjunction with a signaling system for monitoring and closing a window or door. The signaling system can comprise, in addition to a preferred embodiment of an actuation handle, a solar energy converter for converting light energy into electrical energy, having an energy storage unit, in particular a rechargeable battery for storing the generated electrical energy. The solar energy converter can be disposed directly in the window pane, for example. Furthermore, the signaling system comprises a vibration sensor and/or a sound converter mechanism, such as a microphone, for monitoring the window or the door in order to signal an unauthorized opening or damaging of the window or door. For this, the signaling system further comprises a signal processing device having a radio transmission module, which processes the signals received from the vibration sensor or the sound converter mechanism, and can transmit a radio transmission telegram containing data regarding an unauthorized opening or damaging by means of the radio transmission module. The signal processing device is coupled to a solar energy converter, such that it can be supplied with electrical energy. The signal processing device is furthermore preferably designed to function as a repeater for a radio transmission telegram transmitted from the actuation handle according to a preferred embodiment.

Further features and advantages of the disclosure can be derived from the following description of preferred exemplary embodiments of the disclosure, based on the figures and drawings, which illustrate details essential to the disclosure, and from the claims. The individual features can each be implemented in and of themselves, or in numerous arbitrary combinations, in a preferred embodiment of the disclosure.

Figure 2:
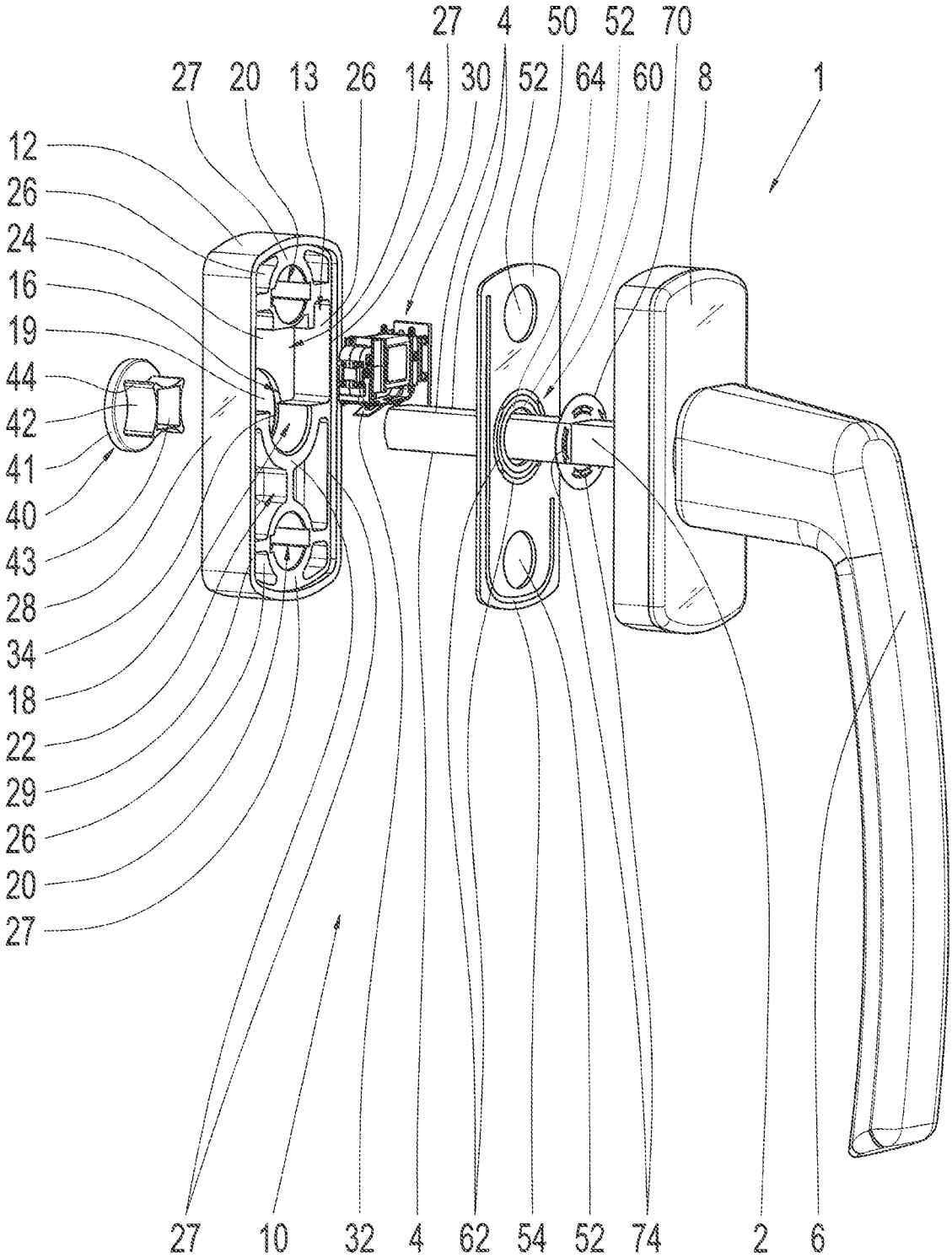
Figure 3:
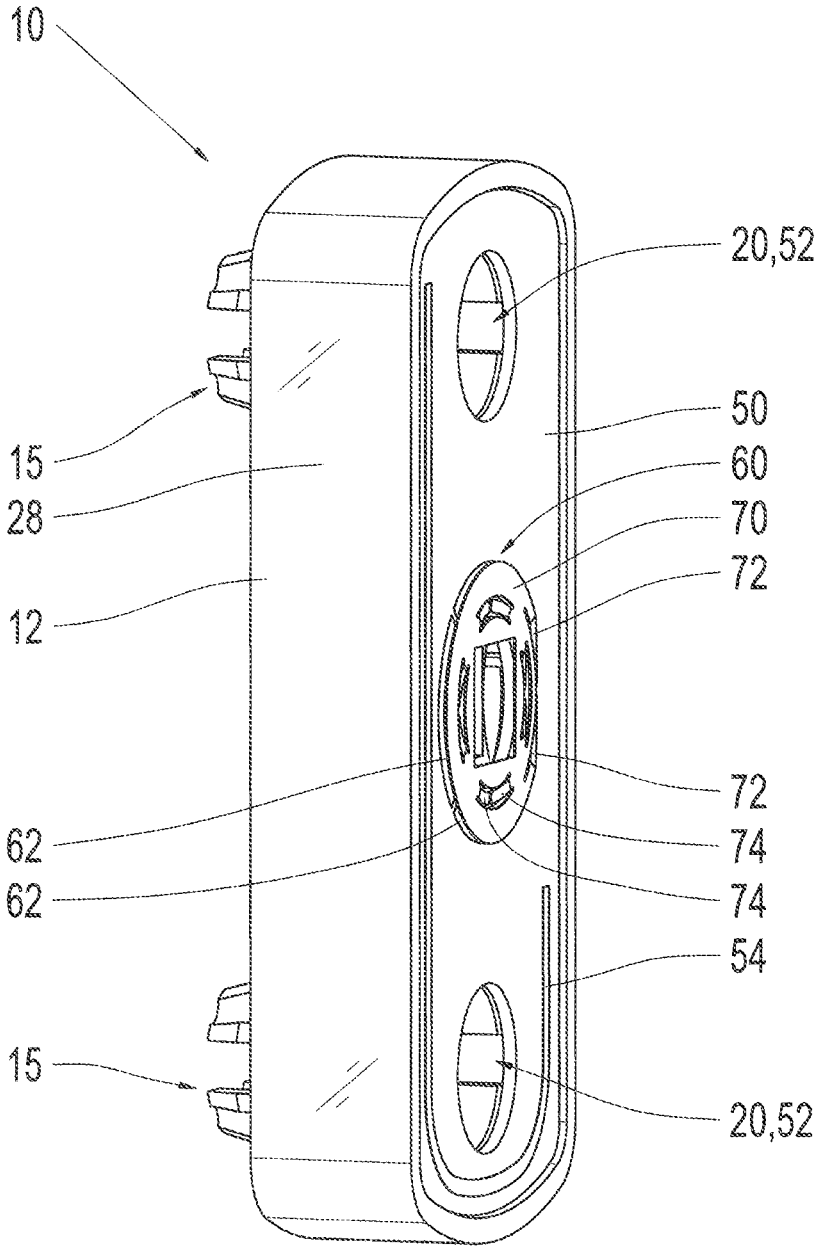
Figure 4:
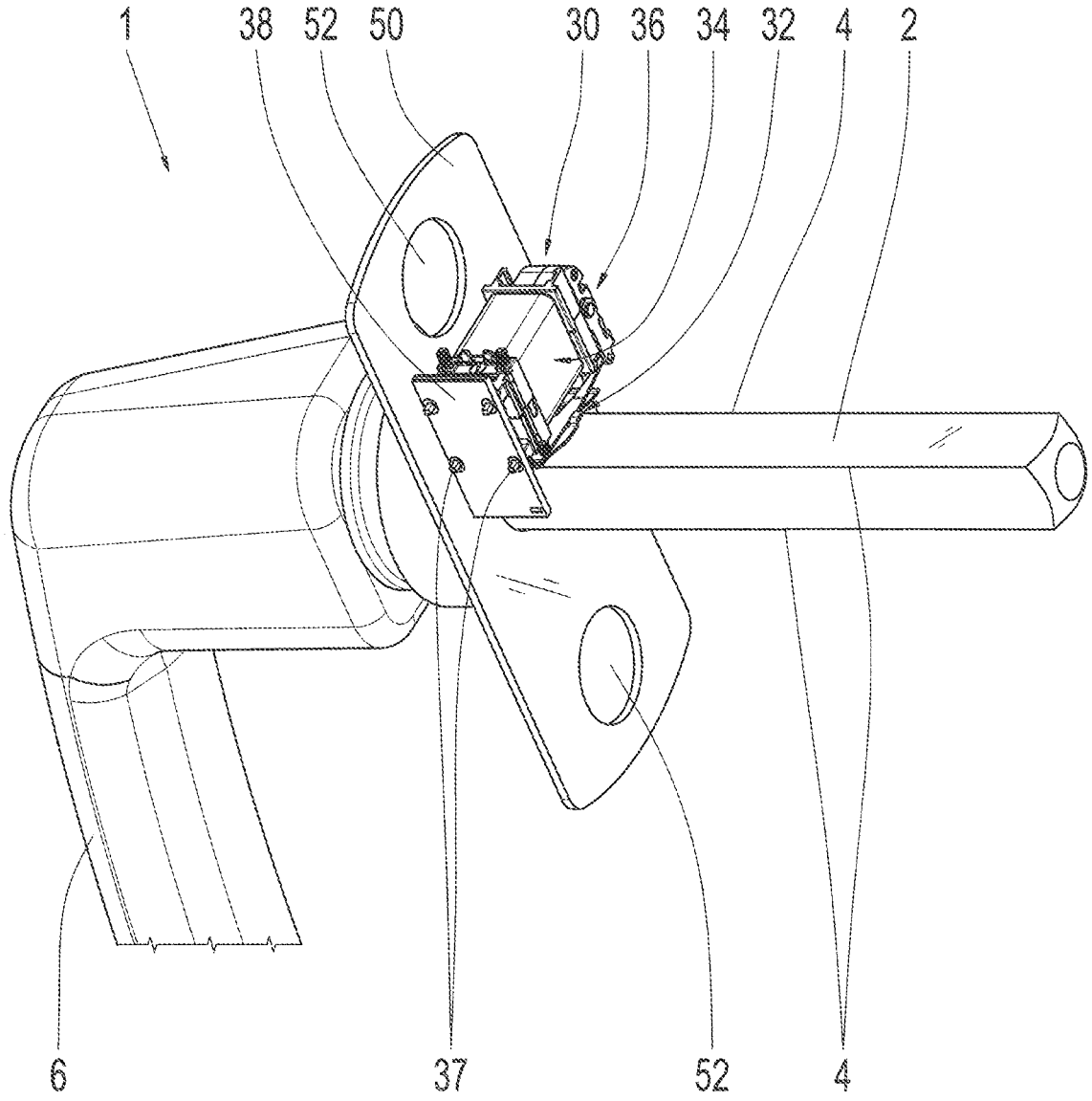
Figure 5:
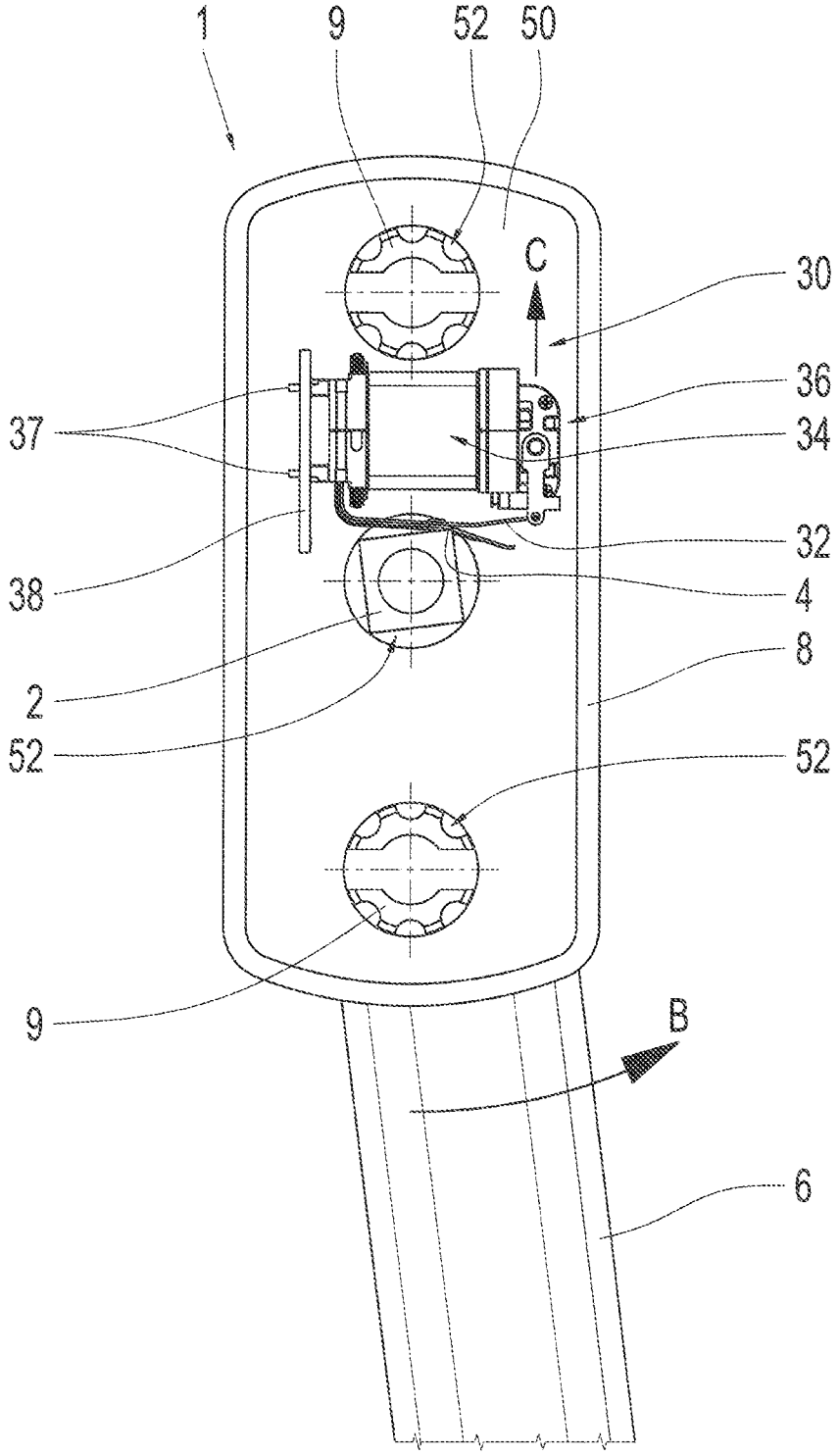
Figure 6:
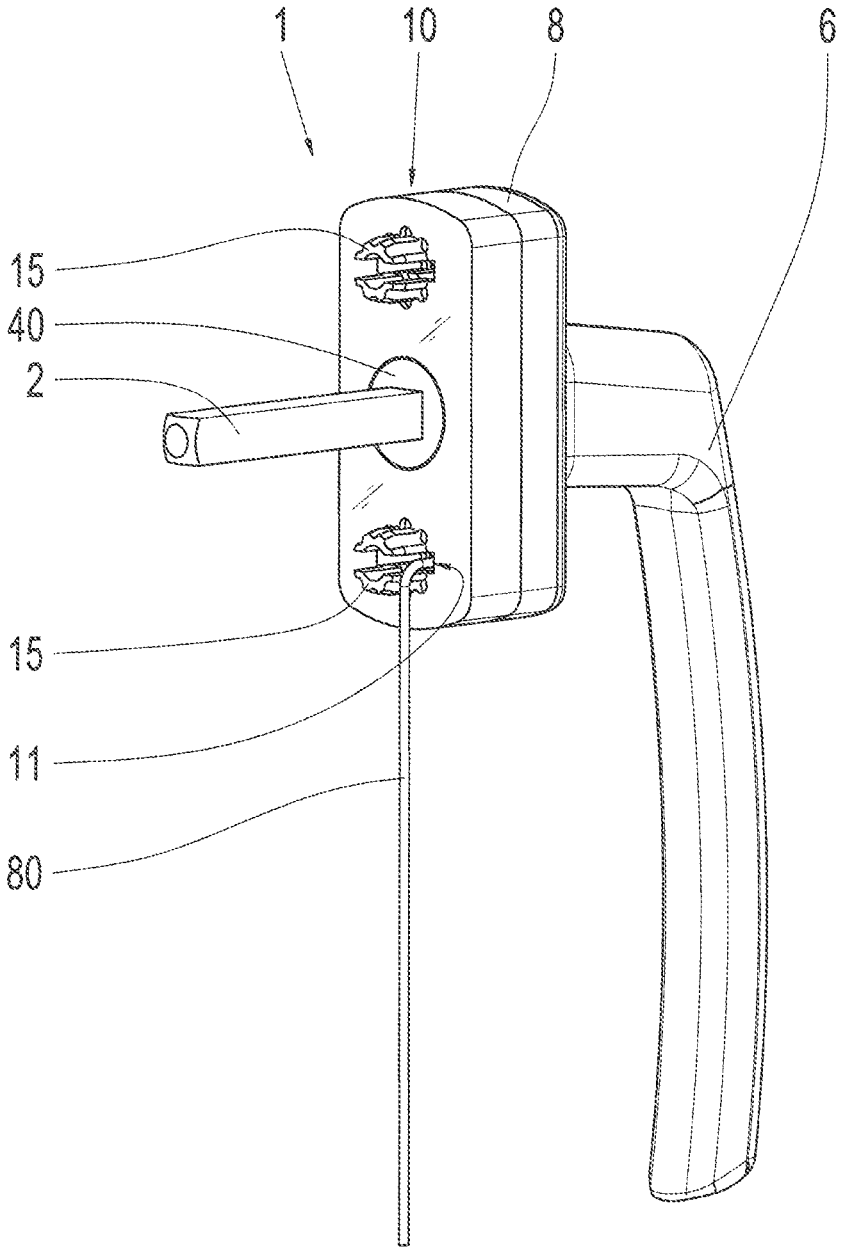
Figure 7:
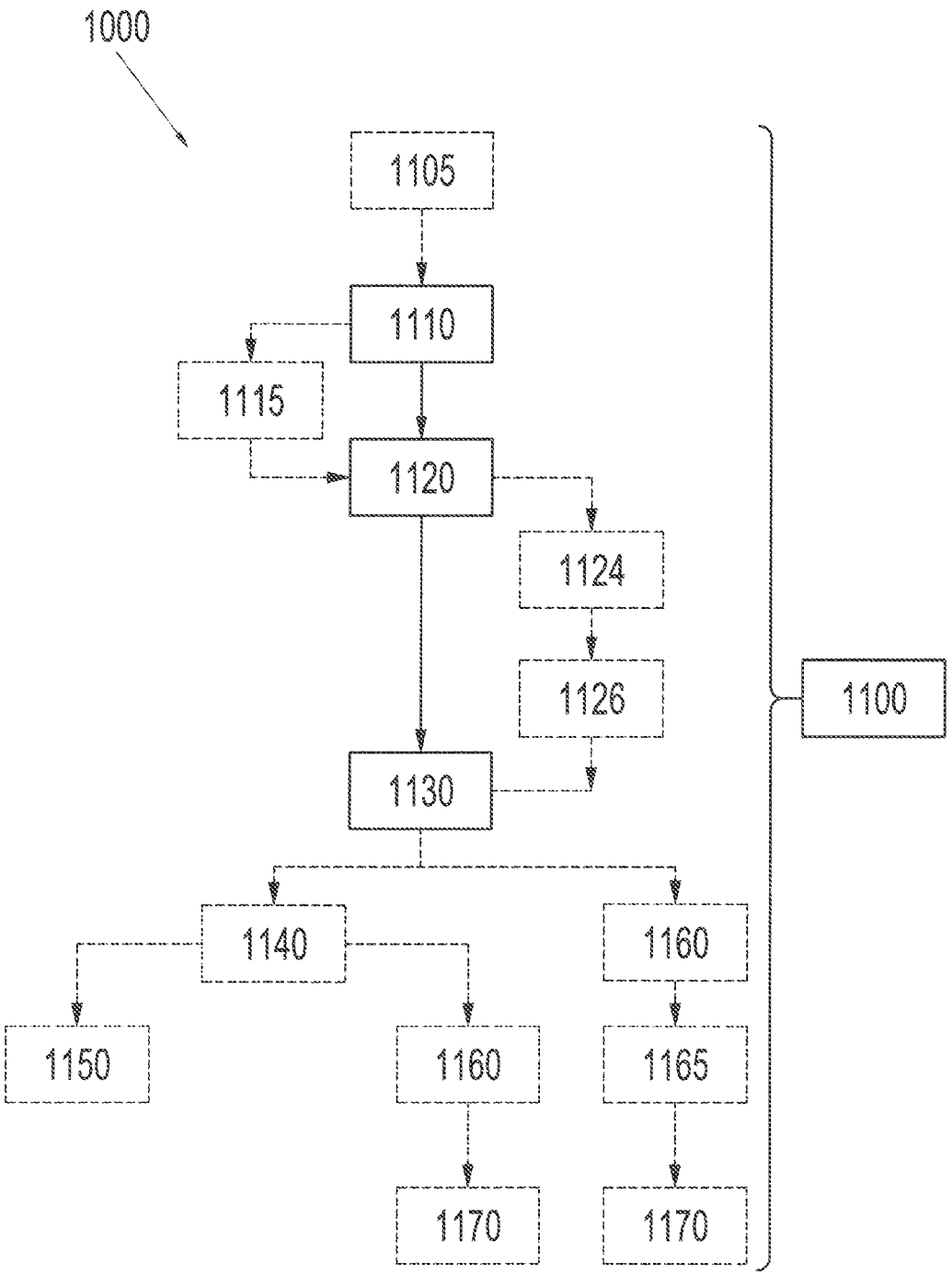
Figure 8:
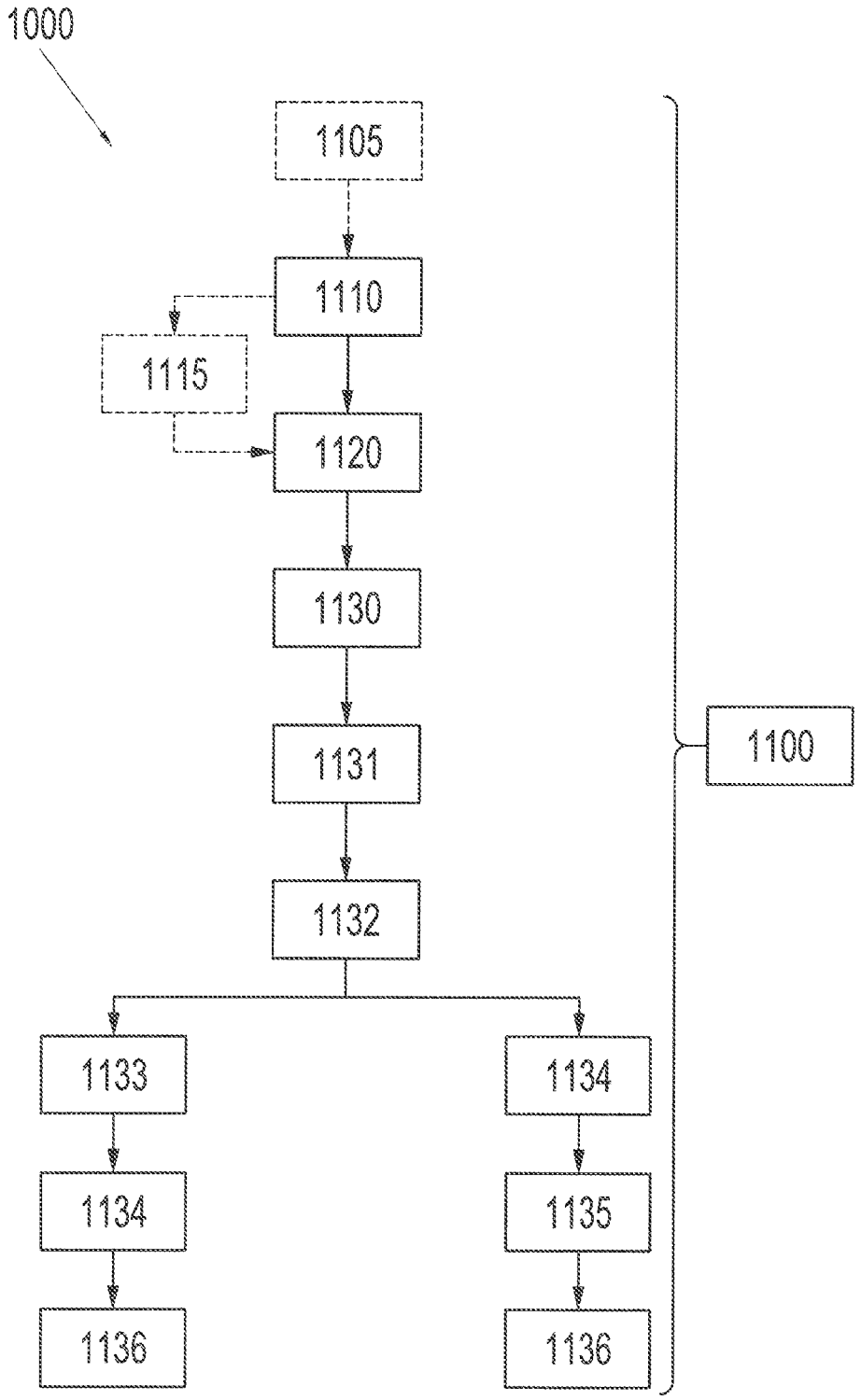

Various exemplary embodiments and details of the disclosure shall be described in greater detail based on the figures described below. Therein:

FIG. 1 shows a perspective side view of an actuation handle, having a device according to a preferred exemplary embodiment, FIG. 2 shows an exploded view of an actuation handle according to a preferred exemplary embodiment, FIG. 3 shows a perspective side view of a device according to a preferred exemplary embodiment, FIG. 4 shows a perspective side view of an actuation handle, having an electronics bearer and energy converter according to a preferred exemplary embodiment, FIG. 5 shows a front view of a partially disassembled actuation handle according to a preferred exemplary embodiment, FIG. 6 shows a perspective side view of an actuation handle, having a device according to a preferred exemplary embodiment, FIG. 7 shows a flow chart for a method for the wireless transmission of a signal generated in an energy self-sufficient manner by means of an actuation handle according to a preferred exemplary embodiment, and FIG. 8 shows a flow chart for a method for the wireless transmission of a signal generated in an energy self-sufficient manner by means of an actuation handle according to a preferred exemplary embodiment.

In the following description of preferred exemplary embodiments of the present disclosure, the same or similar reference symbols shall be used for identical elements, or elements having a similar function, depicted in the various figures, wherein there shall be no detailed repetition of the description of these elements.

FIG. 1 shows a perspective side view of an actuation handle 1, having a device 10 according to a preferred exemplary embodiment. The actuation handle 1 is designed in the form of a window or door handle, and comprises a handle piece 6, which is connected to an actuation bolt 2 having a square shape, having four outer edges 4, such that it can rotate about a longitudinal axis A of the actuation bolt 2. The free end of the actuation bolt 2 facing away from the handle piece 6 is designed to engage in a locking or opening mechanism of a window or door. By rotating the handle piece 6, the accompanying rotation of the actuation bolt 2 and the engagement of the actuation bolt 2 in the mechanism, the actuation handle 1 can be moved between different predetermined functional positions, such as an opening position, in which the window or door can be opened, a closing position, in which the window or door can be closed, and a tilted position, for example, in which the window can be tilted.

The actuation handle 1 comprises a rosette 8, through which the actuation bolt 2 is inserted, and in relation to which the handle piece 6 can rotate. A rosette for an actuation handle is normally provided for attaching the actuation handle to a window frame or a door. In the illustrated preferred exemplary embodiment, the rosette 8 is connected to a device 10 on the side facing away from the handle piece 6, through which the actuation bolt 2 is likewise inserted.

FIG. 2 shows an exploded view of an actuation handle according to a preferred exemplary embodiment. The actuation handle can be an actuation handle such as that illustrated in FIG. 1, for example. As depicted in detail, the device 10 comprises a housing 12 in the form of a pan that is open on one side. The housing 12 can be made, for example, from an injection molded plastic. The housing 12 has two attachment holes 20, which are formed in an interior space 22 of the pan-shaped housing 12 through inner housing walls 26 extending upward from the pan base 24. The attachment holes 20 are designed to receive attachment means received in the rosette 8, or formed by the rosette 8, in order to enable an attachment of the actuation handle 1 to a window frame or a door. The attachment means extending from the rosette 8 can be attachment pins or screw elements, for example, which extend through the attachment holes 20 in order to attach the actuation handle 1 to the window frame or the door.

The housing 12 has a pan-like section 13 inside the interior space 22 of the pan, between the two attachment holes 20, which is formed by further internal housing walls 26 extending upward from the pan base 24. The pan-like section 13 comprises a first receiving section 14 for receiving an energy converter 30 and an aperture 16 bordering on the first receiving section 14, having a second receiving section 18 for rotatably receiving a section of the actuation bolt 2. An aperture hole 19, bordering on the second receiving section 18, is formed in the pan-like section 13 in the pan base 24, through which the free end of the actuation bolt 2 can be inserted.

The inner housing walls 26 are enclosed by a delimiting, circumferential outer housing wall 28, which is connected to the pan base 24 at the edges. The inner housing walls 26 form a support or bearing for a carrier element 50 at their free, front surface ends 27. The free, front surface end 27 is closer to the pan base 24 than the free front surface end 29 of the outer housing wall 28 aligned therewith. As a result, the carrier element 50 can be accommodated in the pan interior 24.

The carrier element 50 has an outer contour corresponding to the inner contour of the outer housing wall 28, by means of which the carrier element 50 covers the pan interior 24 when it is received in the housing 12. In conjunction with the outer housing wall 28, the pan interior 24 can be protected against external effects.

The carrier element 50 has through-holes 52 corresponding to the attachment holes 20 and the positions assigned to the aperture 18, through which the actuation bolt 2 as well as the attachment means for the rosette 8 can be inserted. The carrier element 50 supports a radio transmission antenna 54, which can be coupled to a radio transmission module for wireless transmission of a radio signal. For this, the carrier element 50 is designed as a printed circuit board. The arrangement of the radio transmission antenna 54 on the carrier element 50 enables a reliable emission of the radio signal, as well as a reliable reception of a corresponding radio signal when the radio transmission module is configured for bidirectional communication. The surface area made available by the carrier element 50 can therefore be exploited in an optimal manner for the radio transmission antenna 54.

The carrier element 50 further comprises an encoding element 60 that can be assigned to a position detection device. The encoding element 60 comprises four circle segment-like sliding contact surfaces 62 disposed in a circle, which are disposed on a side of the carrier element 50 facing away from the housing 12 in the proximity of the through-hole 52 provided for the actuation bolt 2. The four sliding contacts 62 are electrically insulated in relation to one another. The encoding element 60 furthermore has a collective sliding contact 64 disposed concentrically to the four sliding contact surfaces 62, which can be electrically coupled to the energy converter 30 via the carrier element 50. Each of the four sliding contact surfaces 62 forms an electrically conductive contact bridge with the collective sliding contact surface 64. A contact element 70 is provided for an electrical connection of the respective contact bridge, which is non-rotatably disposed on the actuation bolt 2 between the carrier element 50 and the rosette 8. The contact element 70 can likewise be assigned to the position detection device. The contact element 70 is formed by an electrically conductive spring-like contact disk, which covers the four sliding contact surfaces 62 as well as the collective sliding contact surface 64. The contact element 70 has, on the side facing the carrier element 50, eight spring-like sliding contact fingers 74 for establishing an electrically conductive contact to the collective sliding contact surface 64, and two spring-like sliding contact fingers 72 for establishing an electrically conductive contact to one of the four sliding contact surfaces 62 respectively, depending on a rotational position of the actuation bolt 2, or the handle piece 6. As a result, a reliable electrically conductive contact between the encoding element 60 and the contact element 70 can be ensured.

Depending on a rotational position of the actuation handle 1, the two sliding contact fingers 72 establish an electrically conductive contact with one of the four sliding contact surfaces 62, while the eight sliding contact fingers 74 establish an electrically conductive contact to the collective sliding contact surface 64. As a result, an electrically conductive connection is produced between one of the four sliding contact surfaces 62 and the collective sliding contact surface 64, when current flows through it as the result of a generation of an electrical energy by the energy converter 62. By assigning the four sliding contact surfaces 62 to respective functional positions, or positions of the actuation handle 1, respectively, a position of the actuation handle 1 can be reliably detected, and transmitted by means of the radio transmission module. Further sliding contact surfaces and corresponding sliding contact fingers that can be assigned thereto for a reliable detection of the position of the actuation handle 1 are conceivable.

As is furthermore shown in FIG. 2, an actuation adapter element 40 can also be provided for the actuation bolt 2. The actuation adapter element 40 is formed from a material containing plastic, and has a disk-shaped stand 41, from which a four-sided receiver element 42 protrudes, having a receiver hole 43 for receiving a section of the actuation bolt 2. The four-sided receiver element 42 has pronounced outer edges 44 on its corners. Two respective adjacent outer edges 44 are connected to one another via a side wall, which has a concave shape facing the receiver hole 43 with a valley disposed centrally between the outer edges 44. The stand 41 has an outer contour corresponding to the through-hole 19, wherein the stand 41 can be rotatably received in the through-hole 19. When accommodated in the housing 12, the four-sided receiver element 42 extends into the interior of the housing 12. The stand 41 bears thereby on a front surface 34 of an inner housing wall 26 extending into the aperture 18, by means of which the actuation adapter element 40 can be secured in the through-hole 19 toward the housing 12.

FIG. 3 shows a perspective side view of a device 10 according to a preferred exemplary embodiment, in a state in which it is accommodating the carrier element 50 and the contact element 70. The carrier element 50 is received entirely in the housing 12, wherein the carrier element 50 is disposed between the pan base 24 and a plane comprising the free front surface end 29 of the outer housing wall 28. In the state in which it is shown, not connected to the rosette 8, the contact element 70 rests on the carrier element 50 such that the contact element 70 is disposed with its base body, from which the sliding contact fingers 72, 74 extend, outside of the plane comprising the free front surface end 29, wherein the sliding contact fingers 72, 74 cross this plane in order to form an electrically conductive contact with the encoding element 60. When the housing 12 is connected to the rosette 8, the contact element 70 is moved toward the carrier element 50 in a spring-like manner, by means of which a reliable contact between the sliding contact fingers 72, 74 and the sliding contact surfaces 62, 64 can be ensured.

As is furthermore shown in FIG. 3, the housing 12 has two attachment pins 15 on the side facing away from the carrier element 50, for attaching the device 10. Each of the attachment pins 15 is formed coaxially to one of the two attachment holes 20, and disposed such that these can engage in attachment holes in, e.g., windows or doors, which are provided for the attachment of commercially available handle devices. Thus, the device 10 can be deployed in commercially available handle devices in conjunction with the attachment holes 20 of the housing 12 in a simple manner.

FIG. 4 shows a perspective side view of an actuation handle, having a carrier element 50 and an energy converter 30 according to a preferred exemplary embodiment. The actuation handle can be an actuation handle 1 such as that shown in FIG. 1 and/or FIG. 2. The carrier element 50, designed as a printed circuit board, comprises the radio electronics as well as at least one logic module that can be electrically coupled thereto in this preferred exemplary embodiment. The logic module can be a component of the radio electronics. The logic module coupled to the radio electronics, or integrated therein, provides, in conjunction with the encoding element 60 and the contact element 70, for a detection of the actuation, or the actuation direction, or the position of the actuation handle 1, and for a supplying of a signal containing the data regarding the actuation, the actuation direction, or the position, wherein the signal can be an encoded signal. The radio electronics comprises further electronic components, by means of which the signal arriving from the at least one logic module can be converted to a radio signal having data regarding the actuation of the actuation handle 1, or having data regarding a detected actuation direction or position of the actuation handle 1, and which can be transmitted wirelessly.

The energy converter 30 is an induction generator known from DE 10 2011 078 932 A1, having a switch element 32, which is coupled to a coil assembly 34 and a magnet assembly 36 such that the magnet assembly 36 can be moved toward the coil assembly 34 by actuating the switch element 32. The switch element 32 is designed as a leaf spring mechanism. The leaf spring mechanism is configured to first store the mechanical energy transmitted during actuation from the actuation bolt 2 via the outer edge 4, or the mechanical energy transmitted from the actuation adapter element 40 shown in FIG. 2 by means of the outer edge 44, and to supply this energy the magnet assembly 36 at a specific switching point, in order to move the same. The switching point has been reached as soon as the amount of stored energy exceeds at least the amount of magnetic self-retaining force between the magnet assembly 36 and the coil assembly 34.

The coil assembly 34 comprises a U-shaped soft magnetic coil core, the respective legs of which are encompassed in an induction coil. The magnet assembly 36 is disposed such that it can be moved linearly on the free ends of the coil core legs, and comprises an E-shaped magnetizable pole shoe assembly, wherein the outer legs of the E-shaped pole shoe assembly are magnetically connected to a magnetic pole of a permanent magnet bordered by the E-shaped pole shoe assembly, and the middle leg of the E-shaped pole shoe assembly is magnetically connected to the other magnetic pole of the permanent magnet. The free leg ends of the E-shaped pole shoe assembly are magnetically coupled to the free leg ends of the coil assembly 34 via a magnetizable sliding plate disposed between the pole shoe assembly and the coil assembly 34. In a first movement end position of the magnet assembly 36, a free end of one of the outer legs of the pole shoe assembly lies opposite a free leg end of the coil assembly 34, and the free end of the middle leg of the pole shoe assembly lies opposite the other free leg end of the coil assembly 34, in each case with the collective sliding plate placed therebetween. In this first movement end position, a magnetic flux having a first direction is generated in the coil assembly 34. In the second movement end position of the magnet assembly 36, the free end of the other outer leg of the pole shoe assembly lies opposite a free leg end of the coil assembly 34, and the free end of the middle leg of the pole shoe assembly lies opposite the other free leg end of the coil assembly 34, in each case with the collective sliding plate placed therebetween. In this second movement end position, a magnetic flux having a second direction is generated in the coil assembly 34, which direction is opposite the first direction. The magnetic flux direction reversal is caused by a movement of the magnet assembly 36 from the first movement end position into the second movement end position, or vice versa, by means of which a corresponding induction voltage is induced in the respective induction coils.

The energy converter 30 has electrical contacts 37 on the side of the coil assembly 34 facing away from the magnet assembly 36, which are electrically connected to another printed circuit board 38 by means of plug-in contacts. The other printed circuit board 38 is electrically coupled to the carrier element 50. In this preferred exemplary embodiment, the other printed circuit board 38 is configured to commutate the individual induction coils of the coil assembly 34. In accordance with another preferred exemplary embodiment, the other printed circuit board 38 carries some or all of the components of the radio electronics and/or the at least one logic module.

FIG. 5 shows a front view of a partially disassembled actuation handle according to a preferred exemplary embodiment. The actuation handle can be an actuation handle 1 such as that described above. In detail, the side of the carrier element 50 facing toward the device 10 is depicted with the energy converter 30. The carrier element 50 is encompassed in this view by the housing walls of the rosette 8, wherein a rosette attachment pin 9 passes through the two outer through holes 52 in each case, which engages in the assigned attachment hole 20 when the device is in the assembled state. The actuation bolt 2 passes through the middle through hole 52, wherein the actuation bolt 2 is accommodated in the middle through hole 52 such that it can rotate freely.

The actuation bolt 2 is shown in a movement state between two functional positions of the actuation handle 1, wherein the actuation bolt 2 is moved by means of pivoting the handle piece 6 along a rotational direction B in the counterclockwise direction when looking toward the end of the plane of the sheet. The actuation bolt 2 comes in contact with the switch element with one of its outer edges 4. If the actuation bolt 2 is rotated further along the rotational direction B, a pressure force transmitted by the outer edge 4 acts on the switch element 32, which is pushed further toward the coil assembly 34 as a result of its elastic spring design, without the magnet assembly 36 moving. The outer edge 4 approaches the actuation bolt 2 during the rotational movement in a continuous manner, until it reaches a point closest to the coil assembly 34, which the outer edge 4 moves away from when the actuation bolt 2 is rotated further along the rotational direction B of the coil assembly 34 shown herein. The magnet assembly 36 is still retained in its first movement end position due to the magnetic self-retaining forces acting between the magnet assembly 36 and the coil assembly 34. The mechanical force in the form of a pressure force acting on the switch element 32 is first stored during the rotational movement of the actuation bolt 2. As soon as the amount of the stored energy exceeds the amount of magnetic self-retaining force as a result of further rotating the actuation bolt 2, or the outer edge 4 approaching the coil assembly 34, the magnet assembly 36 is moved abruptly, along a movement direction C, from the illustrated first movement end position into the second movement end position. The abrupt movement of the magnet assembly 36 preferably occurs before, or alternatively, preferably at the latest, when the outer edge 4 reaches the point that is spatially closest to the coil assembly 34. The actuation bolt 2 is in an actuation end position thereby. This movement causes a magnetic flux direction reversal in the coil assembly 34, by means of which a voltage in the induction coils is induced. The electric energy generated thereby is transmitted via the plug-in contacts 37. As soon as the actuation bolt 2 is rotated in the clockwise direction, opposite to the rotational direction B, a similar actuation of the switch element 32 occurs.

According to a preferred exemplary embodiment, the energy converter 30 is mono-stable, and in other words, is thus self-resetting. For this, the switch element 32 is preferably configured such that it is in a relaxed state when the magnet assembly 36 is in the first movement end position, and is in an elastic tensioned state when it is in the second movement end position. As soon as the amount of pressure force acting on the switch element 32 by the outer edge 4 as a result of further rotation of the actuation bolt 2 is lower than the amount of self-resetting spring force of the switch element 32, and at the same time, the amount of self-resetting force is greater than the amount of magnetic self-retaining force, the magnet assembly 36 is moved abruptly back from the second movement end position into the first movement end position, by means of which a renewed induction voltage is generated.

According to an alternative preferred exemplary embodiment, the energy converter 30 is bi-stable. For this, a reset spring device that resets the magnet assembly 36 is provided, which has an actuatable end, which can be brought into the rotational path of the outer edge 4 after actuation of the switch element 32, such that it can be actuated for switching, and after actuation, remains outside of the rotational path of the outer edge 4 until the switch element 32 is actuated again. The actuatable end of the reset spring device can be disposed upstream or downstream of the switch element 32 in the rotational direction of the actuation bolt 2, or the outer edge 4, such that it can be brought into the rotational path of the outer edge 4. Thus, depending on a use oriented configuration of the actuation handle 1, a double actuation can occur, in order to obtain a high energy gain, or a single actuation of the energy converter 30 can occur during a rotation of the actuation bolt 2, or while the actuation handle 1 is being brought into a functional position from another functional position.

FIG. 6 shows a perspective side view of an actuation handle with a device according to another preferred exemplary embodiment. The actuation handle and the device can each be such as those described above. The actuation handle 1 according to this preferred exemplary embodiment also has an outer antenna element 80 in the form of a rod antenna, which is inserted through a hole 11 in the device, and is electrically coupled to the radio electronics inside the device 10. With this preferred exemplary embodiment, the hole 11 is disposed such that it is adjacent to the attachment pins 15. In this manner, the outer antenna element 80 can extend, for example, into a hollow space in a window profile, by means of which the outer antenna element 80 is hidden from view for a user of the handle 1. The hole 11 can be provided elsewhere on the device 10 if necessary. A radio transmission capacity of the actuation handle 1 can be improved by means of the outer antenna element 80.

FIG. 7 shows a flow chart for a method 1000 for the wireless transmission of a signal generated in an energy self-sufficient manner by means of an actuation handle according to a preferred exemplary embodiment. The actuation handle can be one of the actuation handles 1 described above, for example. The method 1000 has a step for rotating 1100 the at least one outer edge 4; 44 from a starting position toward an end position via an actuation position actuating the energy converter 30 for switching. The rotating step 1100 has a sub-step for generating 1110 electrical energy by means of the energy converter 30. The actuation handle 1 is in an actuating position during this sub-step. This sub-step is followed by a sub-step for generating 1120 a radio transmission telegram containing data regarding the actuation of the actuation handle 1. In this sub-step, the electrical energy generated by the energy converter 30 is used by the electronics connected to the energy converter 30 in order to generate the radio transmission telegram. The radio transmission telegram itself can be regarded thereby as data relating to the actuation of the actuation handle 1. Alternatively or additionally, a polarity of the electrical energy generated by the energy converter 30 can be used by the electronics for detecting an actuation direction of the actuation handle 1, wherein the radio transmission telegram contains not only data regarding the actuation of the actuation handle, but also data regarding an actuation direction of the detected actuation. This sub-step is followed by a sub-step for transmitting 1130 the generated radio transmission telegram.

According to another preferred exemplary embodiment of the method 1000, the energy converter 30 has a mono-stable or bi-stable design, wherein the rotating step 1100 furthermore exhibits sub-steps following the sub-step for transmission 1130 in the sequence, for the renewed generation 1140 of an electrical energy by means of the energy converter 30, and the repeated transmission 1150 of the generated radio transmission telegram. As a result, a transmission reliability can be increased.

According to another alternative preferred exemplary embodiment of the method 1000, the rotating step 1100 furthermore contains sub-steps following the sub-step for transmitting 1130 in the sequence, for generating a new radio transmission telegram 1160 containing data regarding the action of the actuation handle 1 and the transmission 1170 of the new radio transmission telegram, wherein a sub-step for the renewed generation 1140; 1165 of an electrical energy by means of the energy converter can be disposed upstream of the sub-step for the generation 1160 of a new radio transmission telegram, or it can be provided between the sub-step for the generation 1160 of a new radio transmission telegram and the sub-step for the transmission 1170 of the new radio transmission telegram. This can be selected, as needed, depending on the energy consumption of the sub-steps for generating the radio transmission telegram and the new radio transmission telegram, or other aspects relating to energy.

According to another preferred exemplary embodiment of the method 1000, the actuation handle has an electrical position detection device for electrically detecting a position of the actuation handle coupled to the radio transmission module. The actuation handle that has the position detection device can be, for example, one of the actuation handles 1 described above. With the method according to this preferred exemplary embodiment, the rotating step 110 comprises a sub-step for closing 1105; 1115 a contact bridge assigned to a position of the actuation handle 1, disposed upstream of the sub-step for generating 1120 a radio transmission telegram, in order to detect the position of the actuation handle 1, wherein the data in the radio transmission telegram contains data regarding the position of the actuation handle 1. In this case, the closing step 1105; 1115 can already be disposed upstream of the sub-step for generating 1120 a radio transmission telegram, or it can be disposed between the sub-step for generating 1110 electrical energy, and the sub-step for generating 1120 a radio transmission telegram. Thus, in addition to data regarding the actuation of the actuation handle 1, data regarding the detected position of the actuation handle 1 can simultaneously be transmitted in a wireless manner. A status monitoring of the actuation handle can be simplified by this means.

According to another preferred exemplary embodiment of the method 1000, the actuation handle comprises, in addition to a mono-stable or bi-stable energy converter, an electrical energy storage unit, e.g. a capacitor, wherein the rotating step 1100 exhibits a sub-step for the storage 1124 of an excess electrical energy provided between the sub-step for generating 1120 a radio transmission telegram and the sub-step for transmitting 1130 the radio transmission telegram, and a sub-step following this sub-step for the renewed generation 1126 of an electrical energy by means of the energy converter. This preferred method contains the advantage of a higher energy availability, by means of which radio protocols requiring more energy can be reliably transmitted.

According to another preferred exemplary embodiment of the method 1000, the actuation handle has a radio transmission module for bi-directional communication with a radio receiver module. FIG. 8 shows, by way of example, a flow chart for this preferred method 1000, based on the essential sub-steps for generating 1110 electrical energy, generating 1120 a radio transmission telegram, and transmitting 1130 the radio transmission telegram. Therein, the rotating step 1100 furthermore contains sub-steps following the sub-step for transmitting 1130 in the sequence, for switching 1130 the radio transmission module to a receiver mode, and for receiving 1132 a radio confirmation telegram from the radio receiver module by the radio transmission module. This sub-step is followed by either the sub-steps in sequence for the renewed generation 1133 of an electrical energy, the generation 1134 of a new radio transmission telegram, and the transmission of the new radio transmission telegram, or the generation 1134 of a new radio transmission telegram, the renewed generation 1135 of an electrical energy, and the transmission 1136 of the new radio transmission telegram. In doing so, a sub-step for switching the radio transmission module to a transmitting mode can occur prior to or after a sub-step following the sub-step for receiving 1132 a radio confirmation telegram. As a result of the bi-directional communication, a high system reliability or manipulation reliability can be ensured. This is because, when only one of the two transmitted radio transmission telegrams has been received, an error message can be generated on the part of the radio receiver module, which can be a component of a status monitoring device or a control device.

Other sub-steps can certainly be provided between the individual sub-steps of the preferred method 1000 described above. By way of example, according to another preferred exemplary embodiment of the method for an actuation handle having a position detection device, a sub-step for querying a position of the actuation handle by means of an electronic logic module can be disposed downstream of the sub-step for generating an electrical energy, disposed upstream of sub-steps forming a (renewed) generating of a (new) radio transmission telegram. Alternatively, individual sub-step can follow one another directly, in other words, without further sub-steps. Furthermore, in the sub-step for transmitting a radio transmission telegram, a single or a repeated transmission of the radio transmission telegram can occur. This applies equally to the sub-steps for the renewed transmission of the radio transmission telegram or the transmission of a new radio transmission telegram. As a result, a transmission reliability can be further improved.

The exemplary embodiments described herein and illustrated in the figures are selected only by way of example. The dimensions of the geometric shape of the elements described herein are only exemplary, and can be adjusted accordingly.

REFERENCE SYMBOLS

1 actuation handle
2 actuation bolt
4, 44 outer edge
6 handle piece
8 rosette
9 rosette attachment pins
10 detection device
11 hole
12 housing
13 pan-like section
14 first receiving section
15 attachment pins
16 aperture
18 second receiving section
19 aperture hole
20 attachment hole
22 pan interior
24 pan base
26 inner housing wall

27 front surface end of the inner housing
28 outer housing wall
29 front surface end of the outer housing
30 energy converter
32 switch element
34 coil assembly
36 magnet assembly
37 plug-in contact
38 further printed circuit board
40 actuation adapter element
50 carrier element
52 passage
54 radio transmission antenna
60 encoding clement
62 sliding contact surface
64 collective sliding contact surface
70 contact element
72, 74 sliding contact finger
80 outer antenna element
1000 method for the wireless transmission of a signal generated in an energy self-sufficient manner
1100 rotating step
1105, 1115 sub-step for closing a contact bridge
1110 sub-step for generating an electrical energy
1120 sub-step for generating a radio transmission telegram
1124 sub-step for storing an electrical energy
1126, 1133, 1135, 1140, 1164 sub-step for the renewed generation of an electrical energy
1130 sub-step for transmitting a radio transmission telegram
1131 sub-step for switching the radio transmission module to the receiver mode
1132 sub-step for receiving a radio confirmation telegram
1134, 1160 sub-step for generating a new radio transmission telegram
1136, 1170 sub-step for the renewed transmission of the radio transmission telegram
A longitudinal axis
B rotation direction
C movement direction of the magnet assembly

The invention claimed is:

1. A device for an actuation handle having an actuation bolt which has at least one section along its longitudinal axis having at least one outer edge on its circumference, the device comprises a housing having a first receiving section for receiving an energy converter for supplying electrical energy to a radio transmitter by converting mechanical energy into electrical energy, and an aperture for the actuation bolt, wherein the aperture has a second receiving section for rotatably accommodating the section of the actuation bolt having at least one outer edge, wherein the first receiving section is adjacent to the aperture, wherein a switch element of the energy converter extends into a rotational path of the at least one outer edge when the energy converter is in a receiving state, and wherein the switch element is configured to be actuated such that it causes a switching by the at least one outer edge during a rotation of the actuation bolt.

2. The device according to claim 1, wherein the housing has a pan section which forms the first receiving section and the aperture with the second receiving section, wherein the aperture has an aperture hole formed in the pan base facing toward the aperture.

3. The device according to claim 2, wherein the housing has a bearing surface for bearing a carrier element supporting at least one radio transmission antenna, wherein the bearing surface covers a section of the pan section encompassing the aperture when bearing on the housing.

4. The device according to claim 1, further comprising an actuation adapter element that is non-rotatably connected to the actuation bolt and is configured to be accommodated in the second receiving section, wherein the actuation adapter element forms the at least one outer edge on the circumference of the actuation bolt.

5. The device according to claim 1, further comprising a position detection device that is configured to be coupled to the energy converter and the radio transmitter, for electrically detecting a position of the actuation handle, wherein the position detection device comprises an encoding element rotatably coupled to the housing and which encompasses the actuation bolt, and an electrically conductive contact element non-rotatably coupled to the actuation bolt, wherein the encoding element is electrically coupled to the energy converter and has at least one electrically conductive contact bridge that is assigned to a position that the actuation handle is configured to assume, wherein the at least one electrically conductive contact bridge is configured to be switched between an open, non-electrically conductive, state and a closed, electrically conductive state through the contact element, wherein contact bridges assigned to different positions are electrically insulated from one another, wherein a contact bridge assigned to a predetermined position of the actuation handle is switched to an electrically conductive setting, or is closed, while other contact bridges are switched to electrically non-conductive settings, or are opened, when the actuation handle assumes the predetermined position.

6. The device according to claim 5, wherein the encoding element has a least one contact section for each of the positions the actuation handle is configured to assume, and has a further collective contact section that is electrically insulated from the a least one contact section and is disposed concentrically around the a least one contact section, wherein the contact sections assigned to the different positions of the actuation handle are insulated from one another, and wherein the contact element has a first contact for establishing an electrically conductive contact to the collective contact section and a second contact coupled in an electrically conductive manner to the first contact for establishing an electrically conductive contact to one of the contact sections assigned to the different positions of the actuation handle.

7. The device according to claim 6, wherein the encoding element is disposed on a printed circuit board, wherein the at least one contact section and the collective contact section are each formed by sliding contact surfaces, and wherein the first and the second contact are formed by a sliding contact finger protruding from the contact element.

8. An actuation handle comprising:
a handle piece,
the actuation bolt rotatably coupled to the handle piece, and
the device according to claim 1.

9. The actuation handle according to claim 8, further comprising an antenna inserted through a hole in the device, wherein the antenna is electrically coupled to the radio transmitter.

10. The device according to claim 1, wherein the device is configured to be attached to a door or window, the device further comprising a signaling system to monitor access to the door or window, wherein the radio transmitter is configured to transmit a radio transmission containing data regarding the access to the door or window, wherein the signaling system comprises a vibration sensor or a sound converter.

11. The device according to claim 1, wherein the switch element is an elastic spring, wherein the at least one outer edge of the actuation bolt is configured to contact the switch element when the actuation bolt is rotated and wherein the switch element does not actuate the energy converter until the at least one outer edge of the actuation bolt reaches a point closes to the energy converter.

12. The device according to claim 1, wherein the energy converter is mono-stable and comprises a magnet, wherein the switch element is a spring, and wherein energy is configured to be generated as the magnet is moved when a spring force of the switch element is greater than a force of the at least one outer edge on the switch element.

13. The device according to claim 1, wherein the energy converter is bi-stable and comprises a reset spring that extends into the rotational path of the at least one outer edge of the actuation bolt, wherein the reset spring is actuated after the switch element is actuated as the actuation bolt rotates and the reset spring remains outside the rotational path until the switch element is actuated again.

14. A method for the wireless transmission of a signal generated in an energy self-sufficient manner by an actuation handle, wherein the actuation handle comprises a rotatable actuation bolt having at least one outer edge extending into the rotational path of a switch element for an energy converter for converting mechanical energy into electrical energy, such that a rotation of the actuation bolt causes a switching actuation of the energy converter by the actuating the switch element by the at least one outer edge, wherein the generated electrical energy supplies a radio transmitter coupled to the energy converter for the wireless transmission of a radio signal, wherein the method comprises:

rotating the at least one outer edge from a starting position toward an end position through an actuation position that actuates a switching of the energy converter, generating electrical energy with the energy converter, generating a radio transmission containing data regarding the actuation of the actuation handle, transmitting the radio transmission.

15. The method according to claim 14, wherein the energy converter has a mono-stable or a bi-stable design, further comprising:

renewed generation of electrical energy by the energy converter, and repeated transmission of the generated radio transmission.

16. The method according to claim 14, wherein the energy converter has a mono-stable or bi-stable design, further comprising:

renewed generation of electrical energy by the energy converter, generation of a new radio transmission containing information regarding the actuation of the actuation handle, and transmitting the new radio transmission.

17. The method according to claim 14, wherein the actuation handle comprises a device having an electric position detection device coupled to the radio transmitter for electrically detecting a position of the actuation handle, wherein the position detection device comprises an encoding element that is non-rotatably coupled to a housing of the device that encompasses the actuation bolt, and an electrically conductive contact element that is non-rotatably coupled to the actuation bolt, wherein the encoding element is electrically coupled to the energy converter and has at least one electrically conductive contact bridge assigned to a position in which the actuation handle is configured to assume, which at least one electrically conductive contact bridge is configured to be switched between an open, electrically non-conductive state, and a closed, electrically conductive state by the electric contact element, wherein contact bridges assigned to different positions are electrically insulated from one another, wherein a contact bridge assigned to a predetermined position of the actuation handle is switched to an electrically conductive state, or is closed, while the other contact bridges are switched to an electrically non-conductive state, or opened, when the actuation handle assumes the predetermined position, further comprising:

closing a contact bridge assigned to a position of the actuation handle in order to detect a position of the actuation handle, wherein the data in the radio transmission contains data regarding the position of the actuation handle.

18. The method according to claim 14, wherein the energy converter has a mono-stable or a bi-stable design, wherein the radio transmitter is designed for bi-directional communication with a radio receiver, further comprising:

generating a new radio transmission after receiving a radio confirmation from the radio receiver, and transmitting the new radio transmission, renewed generation of electrical energy by the energy converter.

19. The method according to claim 14, wherein the energy converter has a mono-stable or bi-stable design, and wherein the actuation handle comprises an electric energy storage unit, further comprising storing an excess electrical energy in the electric energy storage unit.

20. The method according to claim 14, wherein a polarity of the electrical energy generated by the energy converter is configured to be used to detect an actuation direction of the actuation handle, wherein the radio transmission contains data regarding an actuation direction of the detected actuation.

* * * * *